US007296976B2

(12) United States Patent
Roever et al.

(10) Patent No.: US 7,296,976 B2
(45) Date of Patent: Nov. 20, 2007

(54) DUAL COUNTERWEIGHT BALANCING SYSTEM

(75) Inventors: Douglas Michael Roever, Indianapolis, IN (US); Christopher John Norris, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1 day.

(21) Appl. No.: 10/969,309

(22) Filed: Oct. 20, 2004

(65) Prior Publication Data

US 2006/0083619 A1 Apr. 20, 2006

(51) Int. Cl.
*F01D 5/02* (2006.01)

(52) U.S. Cl. ..... 416/144

(58) Field of Classification Search ..... 416/144, 416/145, 80; 464/180
See application file for complete search history.

(56) References Cited

U.S. PATENT DOCUMENTS

| | | | | |
|---|---|---|---|---|
| 1,191,393 | A | | 7/1916 | Bergstrom |
| 1,305,978 | A | | 6/1919 | Spence |
| 3,799,619 | A | | 3/1974 | LaBarber |
| 4,003,265 | A | | 1/1977 | Craig et al. |
| 4,059,972 | A | * | 11/1977 | Beam et al. ..... 464/23 |
| 4,117,742 | A | | 10/1978 | Stein |
| 4,177,692 | A | | 12/1979 | Irwin |
| 4,835,827 | A | * | 6/1989 | Marra ..... 29/889.2 |
| 4,933,583 | A | | 6/1990 | Ripplinger |
| 5,167,167 | A | | 12/1992 | Tiernan et al. |
| 5,206,988 | A | | 5/1993 | Piramoon |
| 5,450,337 | A | | 9/1995 | Chuan-Yuan et al. |
| 5,555,144 | A | | 9/1996 | Wood et al. |
| 5,810,527 | A | | 9/1998 | Jager et al. |
| 5,931,050 | A | | 8/1999 | Roach |
| 6,288,867 | B1 | | 9/2001 | Jierapipatanakul et al. |
| 6,341,600 | B1 | | 1/2002 | Wakita |
| 6,375,428 | B1 | | 4/2002 | Stangeland et al. |
| 6,483,209 | B1 | | 11/2002 | Horng et al. |
| 6,707,639 | B1 | | 3/2004 | Pfeiffer et al. |
| 2002/0134191 | A1 | | 9/2002 | Czerniak et al. |
| 2003/0213334 | A1 | | 11/2003 | Czerniak et al. |

* cited by examiner

*Primary Examiner*—Edward K. Look
*Assistant Examiner*—Dwayne J White
(74) *Attorney, Agent, or Firm*—Krieg DeVault LLP

(57) ABSTRACT

A system for balancing a rotatable gas turbine engine component. The system includes two balance rings that are coupled to the component by mating splines on the respective item. Each of the rings has a mass asymmetry that is indexable relative to the primary component to achieve the imbalance correction.

14 Claims, 9 Drawing Sheets

*Fig.* 5

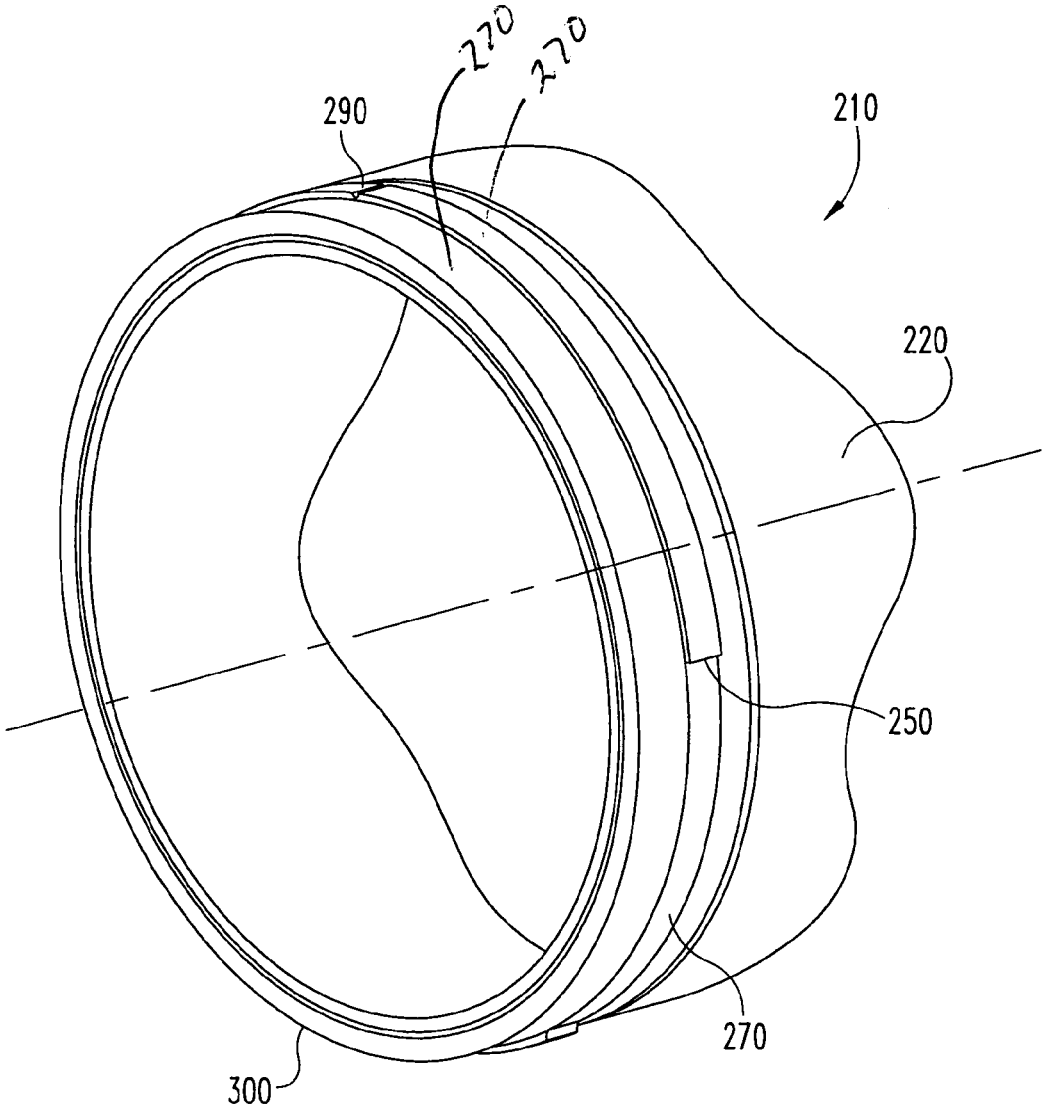
*Fig.* 9

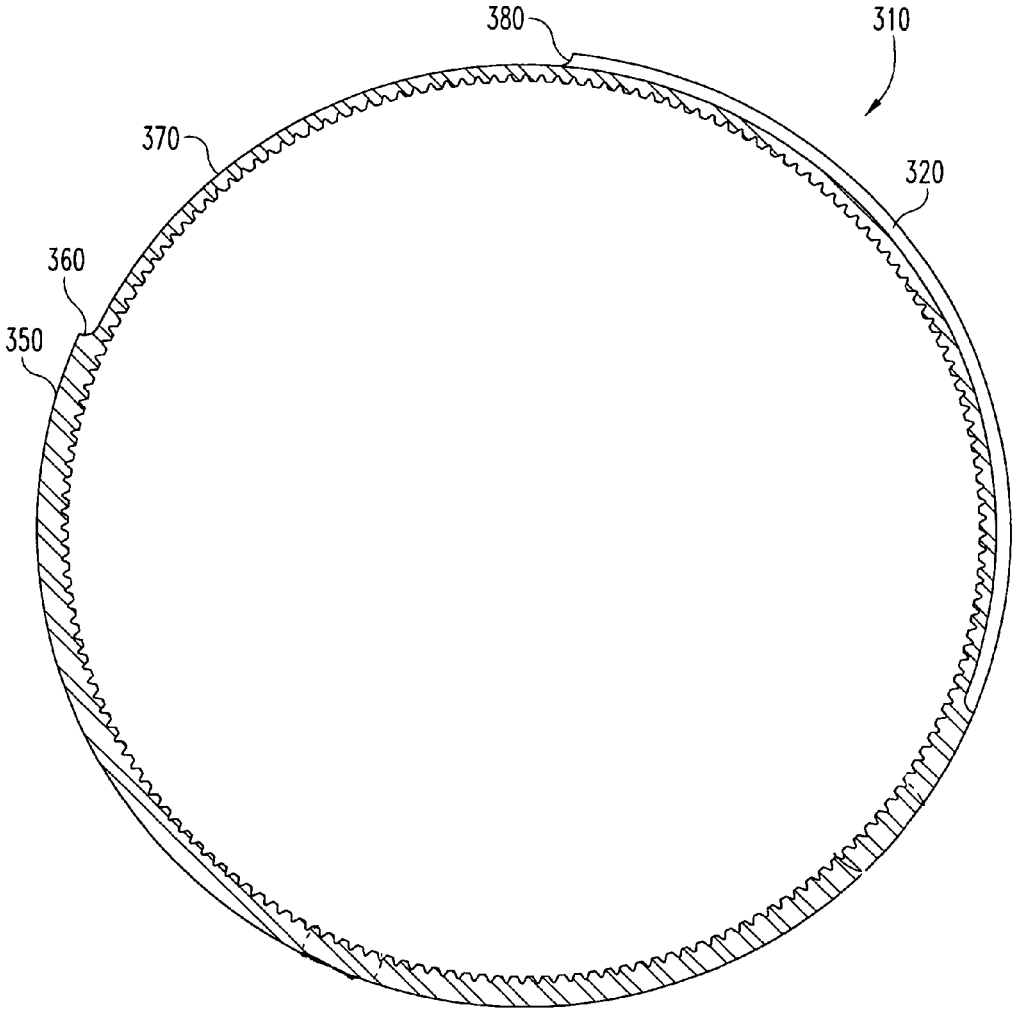
*Fig.* 10

DUAL COUNTERWEIGHT BALANCING SYSTEM

The present invention was made under U.S. Government Contract Number N0019-02-3003 awarded by the Navy, and the Navy may have certain rights in the present invention.

BACKGROUND OF THE INVENTION

The present invention relates generally to a system for correcting an unbalance in rotating components that can result in an unacceptable level of vibration during operation. More specifically, in one form the present invention relates to a balancing system including two mass asymmetric rings that are coupled to the rotating component through a splined interface. Although the present invention was developed for balancing gas turbine engine components, application in other areas of technology are contemplated herein, such as high speed machine tool applications, gearboxes, actuators and motors.

It is recognized that gas turbine engines include components that rotate at high rates of speed. The dynamic unbalance of the components can lead to severe vibration that reduces the useful life of the component.

The engineers and scientists developing gas turbine engine technology recognize that one can add or remove material at select locations to achieve proper balance for the component. Many of the techniques included the addition and removal of separate balance weights from the component and the actual removal of material from the component. The prior balancing techniques that relied upon the adding of separable balance weights are often limited by issues such as: configuration management and structural integrity of the separable weights, additional part count, and lack of flexibility in adjustment. In many of the prior techniques to balance the component, the component had to be removed and sent to a machine shop for machining, which is time consuming and adds the possibility of a machining error in the process. Alternatively, the component may have been hand machined without removal from the machine. In either case, the machining of the component to perfect a balance condition can be very difficult and in many cases any error in machining is irreversible.

Although there are currently many methods to reduce unbalance conditions in rotatable components there remains a significant need for further technological solutions in this area. The present invention satisfies this need and others in a novel and unobvious way.

SUMMARY OF THE INVENTION

The invention is set forth literally in the claims. More generally, invention can be summarized as a method and/or system for balancing a rotatable gas turbine engine component.

One form of the present invention contemplates a system comprising: a rotatable gas turbine engine component adapted to rotate about a centerline, the component including a first circular portion having a first splined surface with a plurality of first spline teeth; and, a pair of counterweight rings located adjacent one another and rotatable with the component, each of the rings having a mass asymmetric portion that is positioned relative to the component to effect an unbalance condition of the component and a second circular portion including a second splined surface with a plurality of second spline teeth for coupling with the plurality of first spline teeth.

Another form of the present invention contemplates a system comprising: a rotatable gas turbine engine member having a surface with a plurality of first serrations; a first continuous ring having a mass asymmetry, the first continuous ring having a first surface with a plurality of second serrations configured to engage with the plurality of first serrations; a second continuous ring having a mass asymmetry, the second continuous ring having a surface with a plurality of third serrations configured to engage with the plurality of first serration; and, each of the rings are indexable relative to the member independent of one another.

Yet another form of the present invention contemplates a method of balancing a rotatable gas turbine engine component with two balance rings having an imbalance. The method comprising: determining the orientation of each of the two balance rings to locate a mass imbalance portion of each of the balance rings relative to the component to effect an unbalance correction of the rotatable component; mating the spline teeth of a first one of the balance rings with the spline teeth of the component to position the mass imbalance portion of the first one of the balance rings proximate the orientation in the determining act; positioning a second one of the balance rings adjacent the first one of the balance rings; mating the spline teeth of the second one of the balance rings with the spline teeth of the component to position the mass imbalance portion of the second one of the balance rings proximate the orientation from the determining act; and, restraining movement of the two balance rings relative to the component.

In yet another form the present invention contemplates a system comprising: a gas turbine engine component that is rotatable about a centerline, the component including a bore extending parallel with the centerline and having a plurality of first spline teeth; two balance correction rings located non-concentrically and adjacent one another and within the bore, each of the rings is coupled with the plurality of first spline teeth by a corresponding plurality of second spline teeth defined on each of the rings, and each of the rings having a mass imbalance portion that is located relative to the component to effect an unbalance correction of the component.

In yet another form the present invention contemplates a system comprising: a rotatable gas turbine engine member having a circular outer surface with a plurality of first splines; a first continuous ring having a mass asymmetry, the first continuous ring having an inner surface with a plurality of second splines configured to engage with the plurality of first serrations; a second continuous ring having a mass asymmetry, the second continuous ring having an inner surface with a plurality of third splines configured to engage with the plurality of first splines; and, each of the rings are indexable relative to the member independent of one another.

One object of the present invention is to provide a unique system for balancing a rotatable gas turbine engine component.

Related objects and advantages of the present invention will be apparent from the following description.

BRIEF DESCRIPTION OF THE DRAWINGS

FIG. 9 is an assembled view of the balancing system of FIG. 7.

FIG. 10 is a cross-sectional view of another embodiment of a balance ring applicable with a balancing system of the present invention.

DESCRIPTION OF THE PREFERRED EMBODIMENTS

Figure 1:
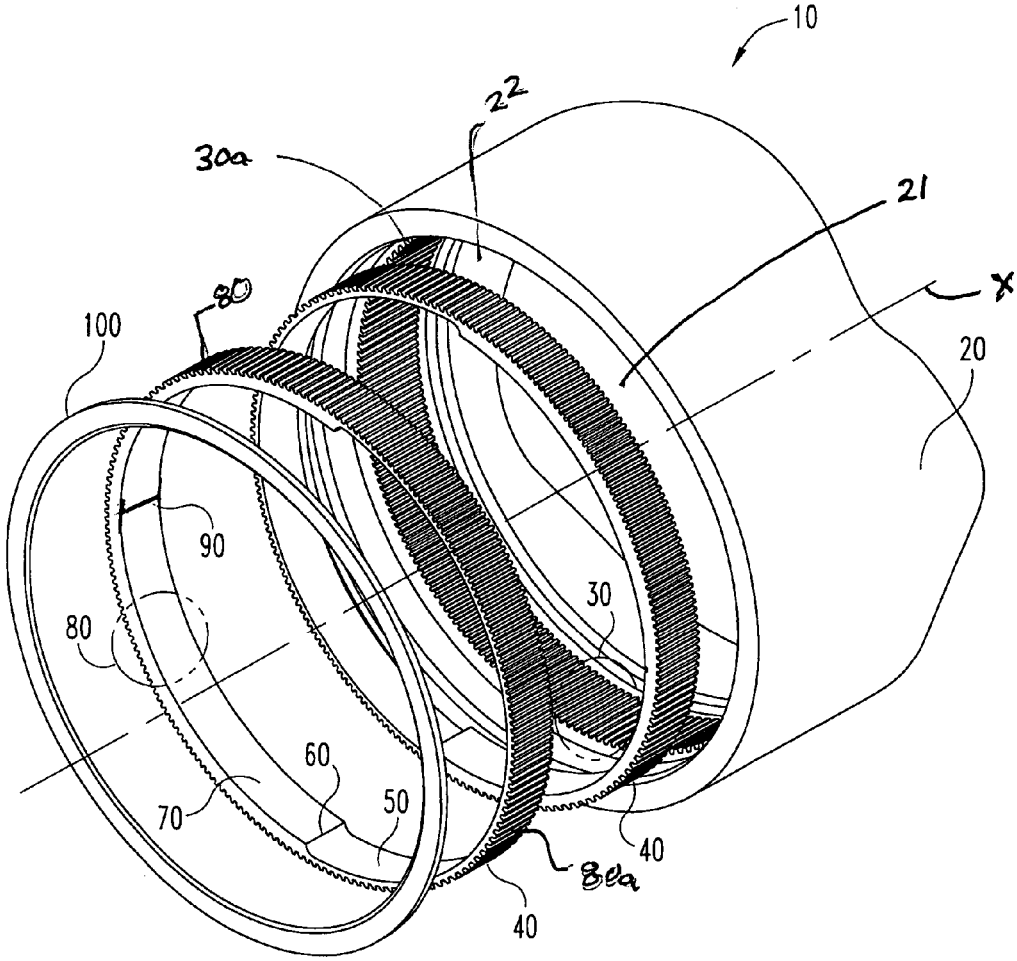
FIG. 1 is an exploded view of one embodiment of a balancing system for a rotatable component.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIGS. 1-5, there is illustrated one embodiment of a balancing system 10 comprised of a rotatable component 10 and counterweight balance rings 40. The term component is intended to be read very broadly and includes, but not limited to, a unitary item, multi-part items, assemblies, shafts, disks, drums and/or gears. Further, in one form, the present invention is particularly useful for balancing the rotating components of gas turbine engines including, but not limited to compressor disks and assemblies, turbine disks and assemblies, gears and shaft assemblies, fan disks and assemblies. The present invention is generally applicable to a variety of applications including those needing single or multi-plane balancing. The text will describe the present invention with reference to gas turbine engine components, however it should be appreciated that the present invention is also contemplated for utilization in other fields of technology.

The embodiment of the present invention illustrated in FIG. 1 includes that component 20 is rotatable about a longitudinal centerline X. In balancing a component with the present invention the operating speeds contemplated for the gas turbine engine components to be balanced are within a range of 3,000 to 20,000 revolutions per minute (RPM), and preferably within a range of 3,000 to 10,000 RPM. However, other operating speeds are fully contemplated herein. In one form the component 20 has an opening/recess 21 at one end. An axial stop 22 is located within the component and limits the distance that the counterweight balance rings 40 can be positioned within the opening/recess 21. In one form the counterweight balance rings are positioned adjacent to one another and are non-concentric. The application contemplates that the opening/recess 21 can extend only a partial length of the component or may extend the entire length of the component 20.

Opening/recess 21 has a portion with a circular inner surface including a spline 30 formed thereon. In one form a wall of the component 20 defines the opening/recess 21. The term spline as utilized herein is intended to be read broadly and includes, but is not limited to, serrations, teeth, notches key slots, and index holes unless specifically provided to the contrary. The spline 30 is preferably defined by a plurality of spline teeth 30*a* that are spaced around the circumference of the circular inner surface. However, the present invention also contemplates that there may only be a few teeth/serrations in the spline. In one form the spline teeth 30*a* are circumferentially spaced around a substantial majority of the component. In another form the spline teeth 30*a* are circumferentially spaced around the entire circular inner surface. The spline teeth 30*a* in one embodiment are formed substantially parallel with the centerline X, however other geometric relationships between the spline teeth 30*a* and the centerline X are contemplated herein. In one form the spline teeth 30*a* have a pitch within a range of about 16 to 40 teeth/inch, however other pitches are contemplated herein.

The counterweight balance rings 40 are preferably a continuous hoop structure that has a circular external surface sized to fit within the opening/recess 21. In one form of the present invention the counterweight balance rings are substantially identical. The continuous hoop structure defines a continuous ring that is not interrupted as in a split ring. In one form the counterweight balance rings 40 are capable of carrying their own centrifugal load at the rotational speeds associated with the rotating component. Each of the counterweight balance rings 40 have a substantially constant outer diameter including a circular outer surface with a spline 80 formed thereon. The spline 80 is preferably defined by a plurality of spline teeth 80*a* that are spaced around the circumference of the circular outer surface. In one form the spline teeth 80*a* are circumferentially spaced around a substantial majority of the counterweight balance ring 40. However, in another form the spline teeth 80*a* are circumferentially spaced around the entire circular outer surface. Spline teeth 80*a* are preferably formed substantially parallel with the centerline X, however other geometric relationships between the spline teeth 80*a* and the centerline X are contemplated herein. The spline teeth 80*a* are configured to engage with the spline teeth 30*a* to couple the counterweight balance ring 40 to the component 20 and limit the circumferential and radial motion between each of the counterweight balance rings 40 and the component 20 during rotational movement of the component. Counterweight balance rings 40 are coupled to and rotate with the component 20.

Figure 2:
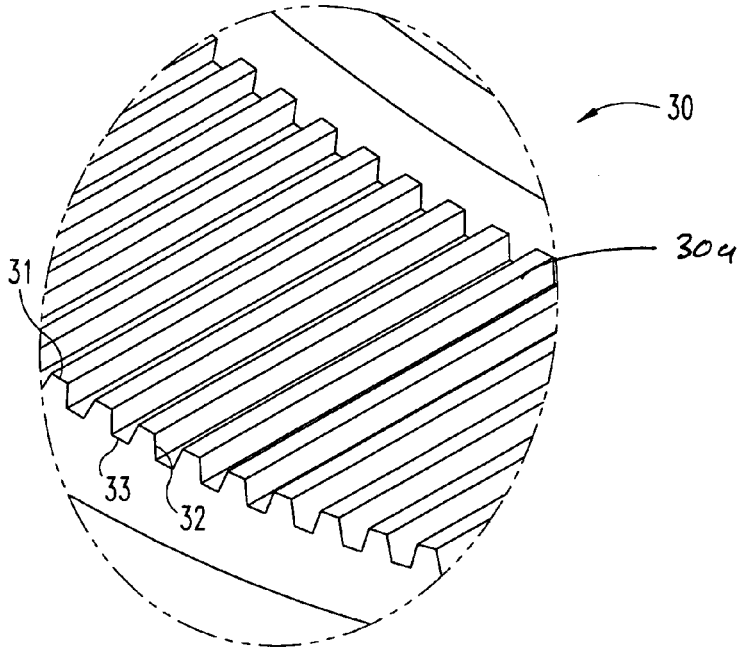
FIG. 2 is a perspective view of one embodiment of the splines formed on the component comprising a portion of FIG. 1.
Figure 3:
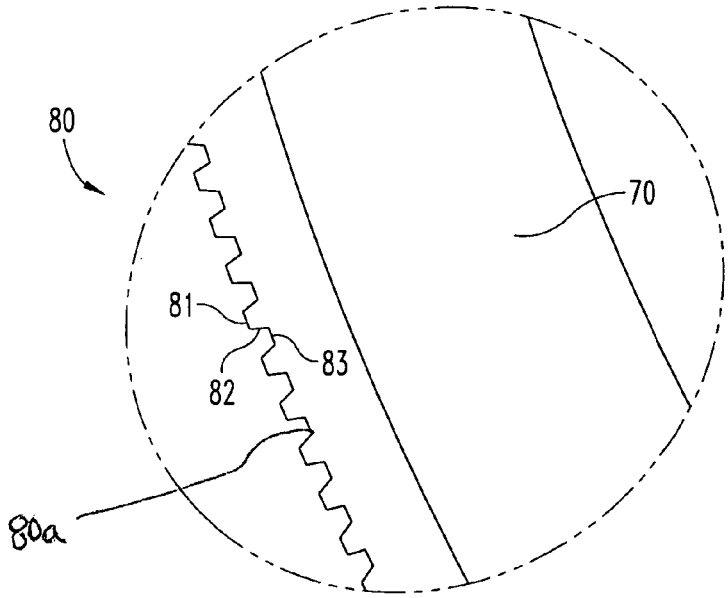
FIG. 3 is a perspective view of one embodiment of the splines formed on the balance rings comprising a portion of the balancing system of FIG. 1.

With reference to FIG. 2, there is illustrated an enlarged view of one embodiment of the plurality of spline teeth 30*a*. A flat apex 31 is connected to a substantially constant ramp 32 to an edge 33, which characterizes the embodiment of the spline teeth 30*a* illustrated in the figure. However, other geometric relationships for the spline teeth 30*a* are contemplated herein. With reference to FIG. 3, there is illustrated an enlarged view of one embodiment of the spline teeth 80*a* configured to mate with the spline teeth 30*a*. A flat apex 81 is connected to a substantially constant ramp 82 to an edge 83, which characterizes the embodiment of the spline teeth 80*a* illustrated in the figure. However, other geometric relationships for the spline teeth 80*a* are contemplated herein. The spline teeth 30*a* and 80*a* form a mechanical mating engagement.

Each of the counterweight balance rings 40 have a mass asymmetry that is adapted to be oriented relative to the component 20 to create an unbalance correction. The unbalance correction can be within the range of zero to twice that of the balance ring. In a preferred form the two counterweight balance rings 40 are indexed relative to one another to effect a net unbalance correction vector varying from either zero correction (imbalance of two rings are 180° apart) to a maximum imbalance correction of twice that of the balance ring, by placing the two imbalances in phase with each other. In one embodiment each of the counterweight balance rings 40 is moveable/indexable independently of the other counterweight balance ring 40 and they are not mechanically fastened to one another. The present application contemplates that in one form each of the counterweight balance rings 40 has a known and equal level of imbalance.

Figure 4:
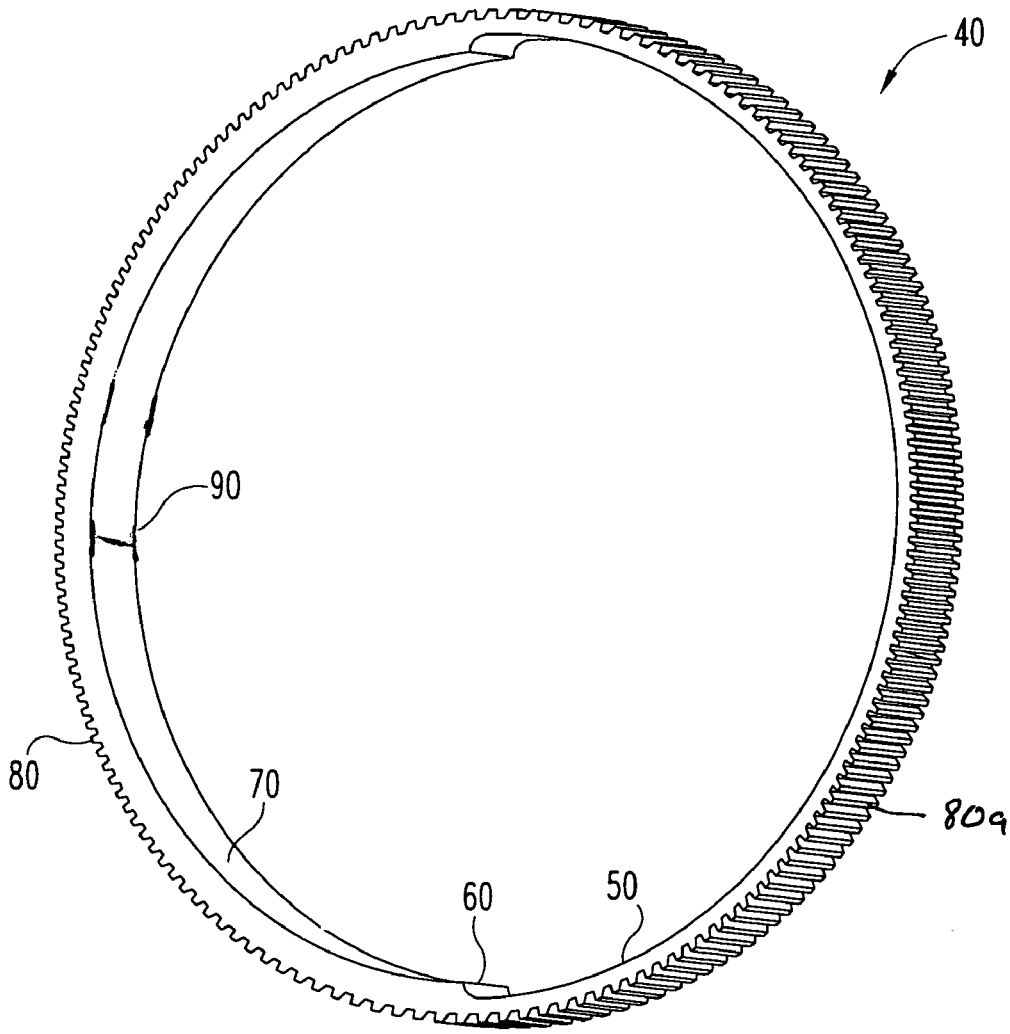
FIG. 4 is a perspective view of one embodiment of a balancing ring comprising a portion of the balancing system of FIG. 1.

With reference to FIG. 4, there is illustrated one embodiment of counterweight balance ring 40. Varying the inner diameter has created the mass asymmetry of the counterweight balance ring. In one form the mass asymmetry is defined on an arc up to 180° in circumferential extent. The maximum inner diameter of counterweight balance ring 40 is defined to surface 50 and extends over about 180° of the circumference. A minimum inner diameter of the counterweight balance ring 40 is defined to surface 70 and extends over the remaining portion the circumference. In one form of the invention a transition 60 blends together the portions associated with the maximum inner diameter and the minimum inner diameter. The present application contemplates other techniques of creating a mass asymmetry for the counterweight balance ring, including, but not limited to a ring assembly including materials of dissimilar densities and/or an arc of removed spline teeth.

In one form of the present invention each counterweight balance ring 40 includes an orientation mark 90 to identify a predetermined position of the mass imbalance. Notching, stamping, painting, marking with ink or chalk, among other techniques known to one of ordinary skill in the art can be utilized to make the orientation mark 90. The orientation mark 90 is used for relative indexing of the counterweight balance rings 40. In another form of the present invention the counterweight balance rings do not include an orientation mark.

Figure 5:
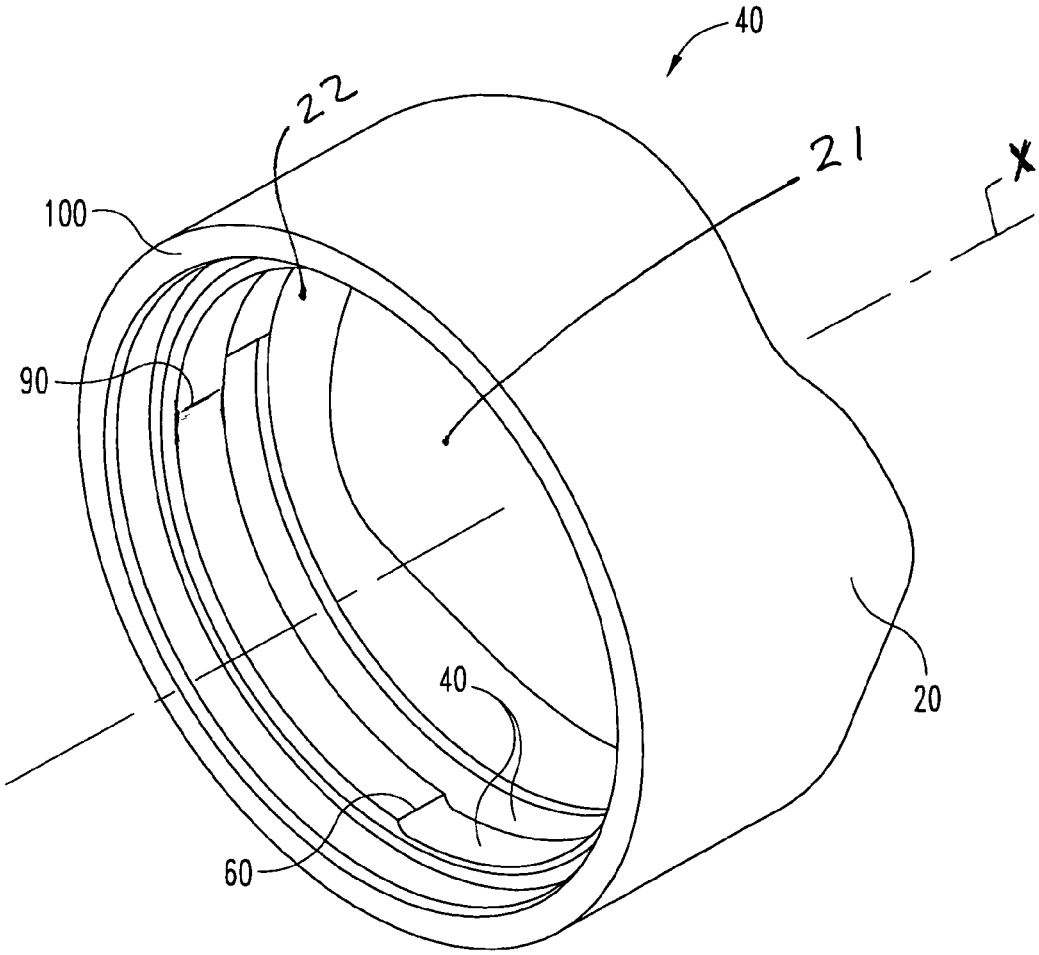
FIG. 5 is an assembled view of the balancing system of FIG. 1.

With reference to FIG. 5, there is illustrated one embodiment of the counterweight balance rings 40 located with the recess/opening 21. Each of the counterweight balance ring 40 have been oriented to a desired position and the plurality of spline teeth 30*a* and 80*a* are mated within the opening/recess 21. A retainer 100 is used to fix the counterweight balance rings 40 in place axially after installation. The retainer 100 can be, but is not limited to, a snap ring, spanner nut, pins, retaining plate and shaft and face. The position of the counterweight balance rings 40 relative to one another in FIG. 5 is purely illustrative. There is no intention herein to limit the present application to the relative orientation of the counterweight balance rings 40 as set forth in the drawing. In one form of the present invention the counterweight balance rings 40 are adapted to be indexed to balance the component without any need for machining or other in situ changes in mass of the component.

Figure 6:
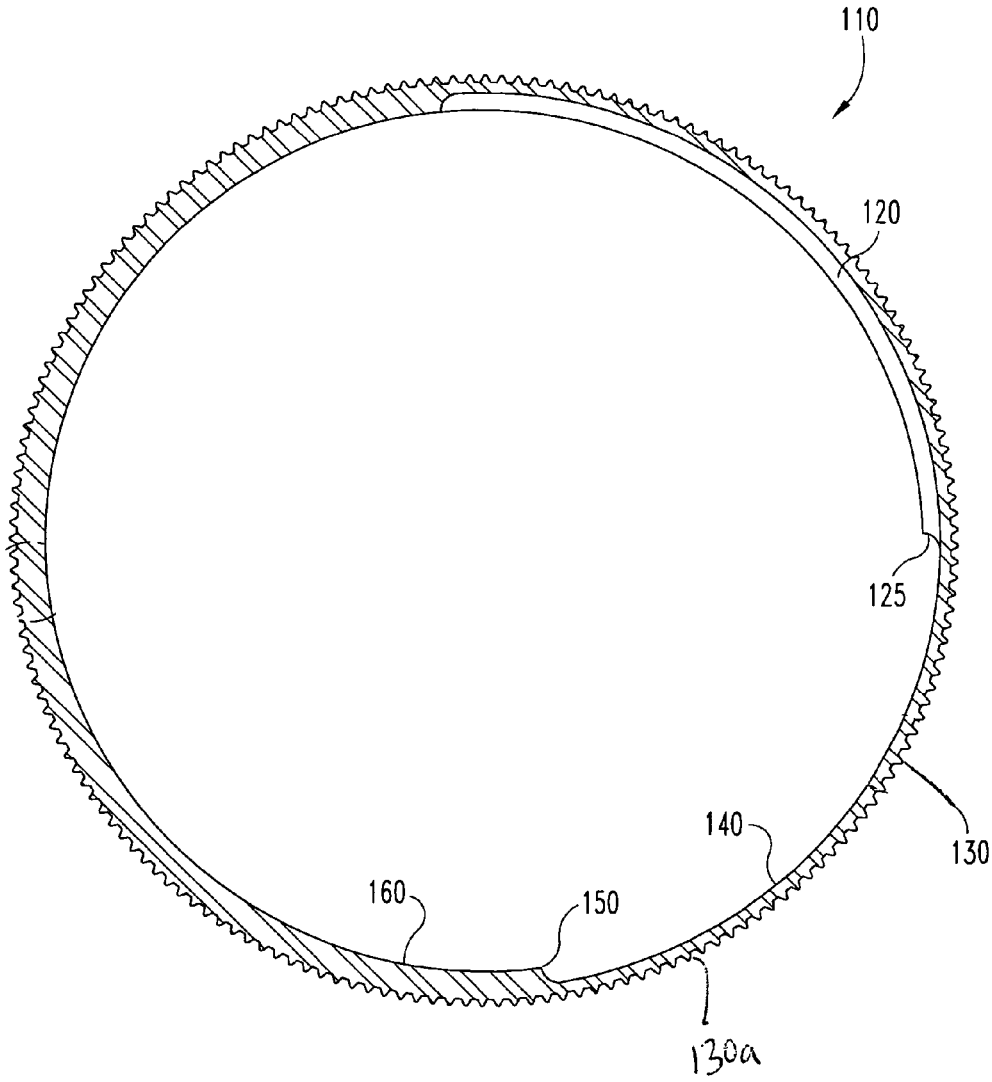
FIG. 6 is a cross-sectional view of another embodiment of a balance ring applicable with a balancing system of the present invention.

With reference to FIG. 6, there is illustrated in cross section another embodiment of a counterweight balance ring 110. The counterweight balance ring 110 is an undercut ring having a minimum inner diameter defined to surface 160. In one form the minimum inner diameter of ring 110 extends over a majority of the circumference of undercut ring 110. A maximum inner diameter of undercut ring 110 is defined to surface 140 and extends over the remaining minority of the circumference of ring 110. A transition 125 and transition 150 blends the maximum and minimum inner diameter. The present application contemplates that the axial width may be varied as needed to fit the particular application. Further, the radial thickness is contemplated as being variable and a combination of the axial width and radial thickness can be adjusted to obtain the desired imbalance within the physical design envelope.

Spline 130 on the circular outer surface of ring 110 includes a plurality of spline teeth 130*a*. The plurality of spline teeth 130*a* on the outer surface mate with the plurality of spline teeth 30*a* formed on the component 20. The counterweight balance ring 110 may include the orientation mark as described above.

Figure 7:
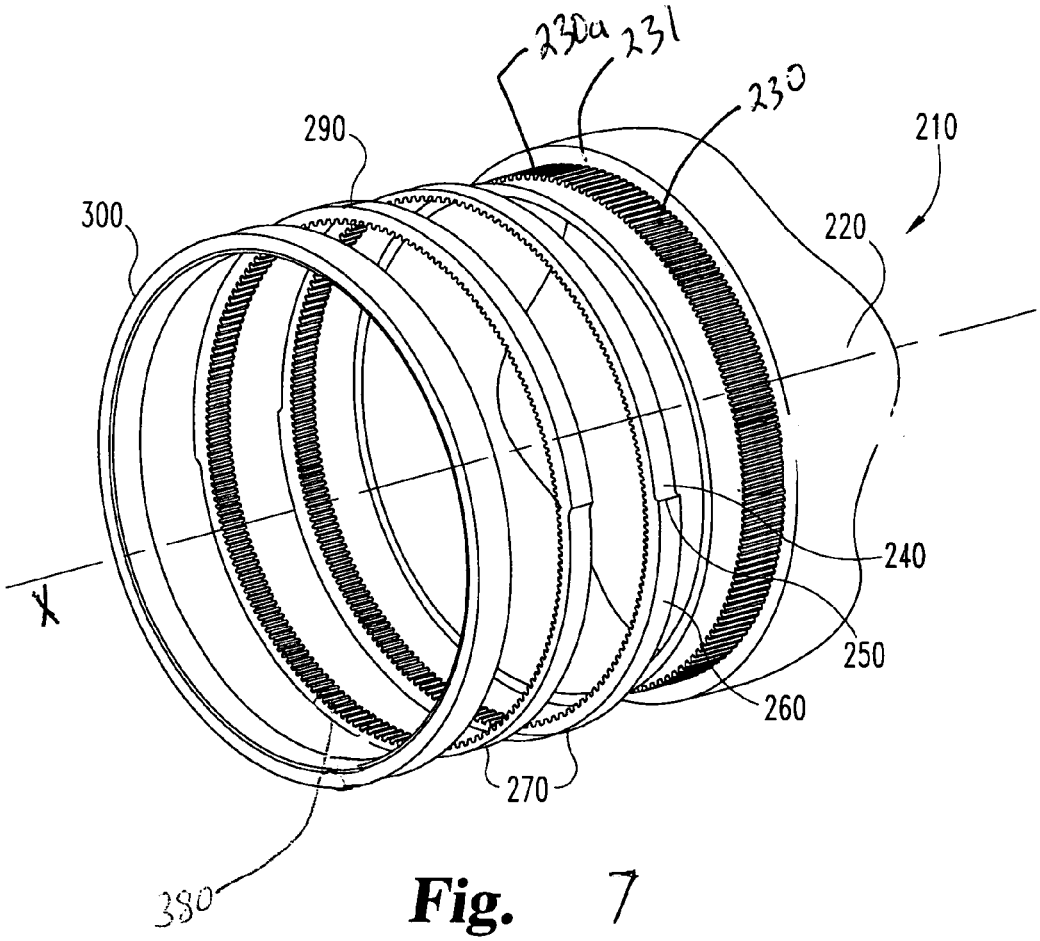
FIG. 7 is an exploded view of another embodiment of a balancing system of the present invention.
Figure 8:
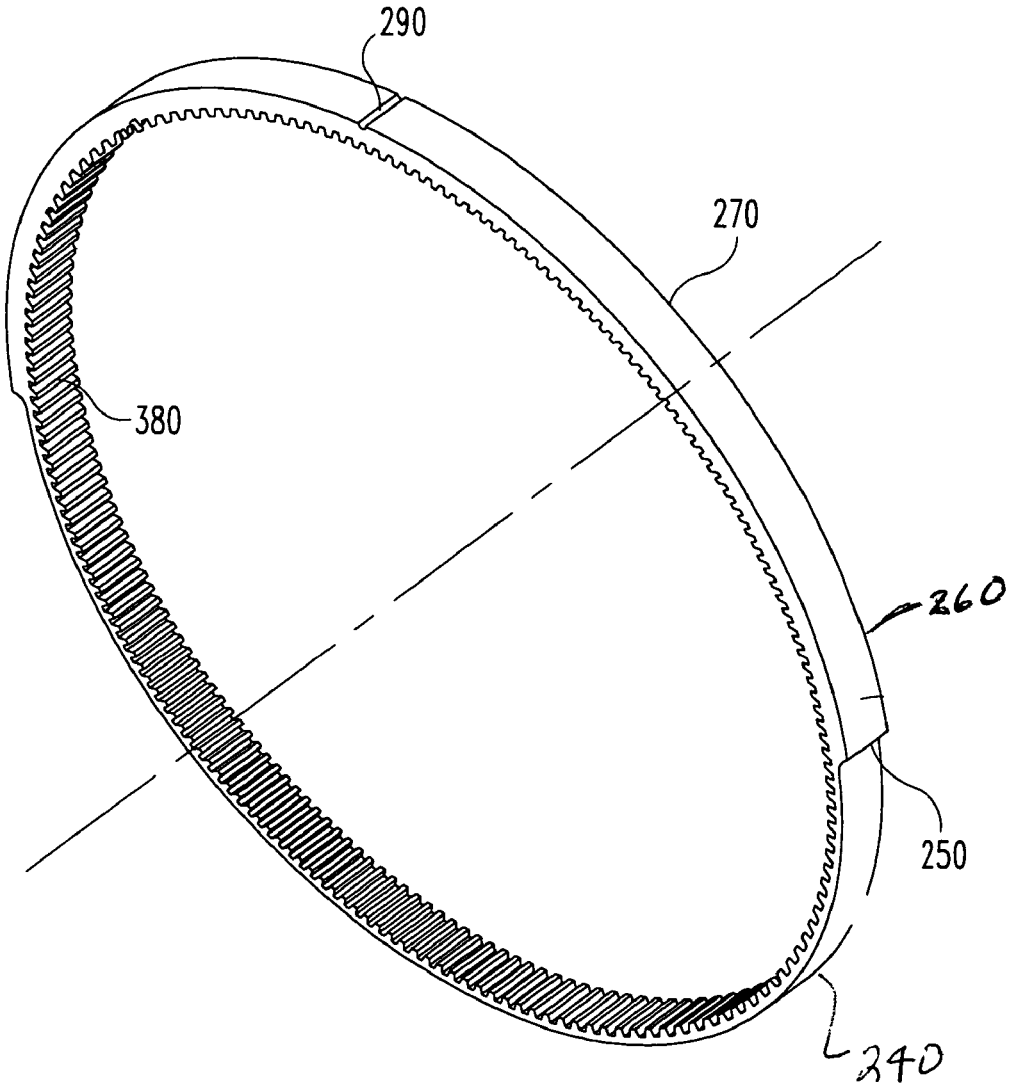
FIG. 8 is a perspective view of one embodiment of a balancing ring comprising a portion of the balancing system of FIG. 7.

With reference to FIGS. 7-9 there is illustrated another embodiment of a balancing system 210 comprised of a rotating component 220 and counterweight balance rings 270. The component 220 rotates about centerline X and has a circular outer surface at one end and an axial stop 231. The axial stop 231 limits the distance that the counterweight balance rings 270 can be placed onto the component 220.

A spline 230 having a plurality of spline teeth 230*a* are spaced around the circumference of the circular outer surface. In one form the spline teeth 230*a* are circumferentially spaced around a substantial majority of the component. In another form the plurality of spline teeth 230*a* are circumferentially spaced around the entire circular outer surface. The spline teeth 230*a* in one embodiment are formed substantially parallel with the centerline X, however other geometric relationships between the spline teeth 230*a* and the centerline X are contemplated herein.

The counterweight balance rings 270 have a circular inner surface that is sized to fit on the circular outer surface of the component 220. The counterweight balance rings 270 are preferably of a continuous hoop structure and have a splined inner surface with a plurality of spline teeth 380. The continuous hoop structure defines a continuous ring that is not interrupted as in a split ring. In one form the counterweight balance rings 270 are capable of carrying their own centrifugal load at the rotational speeds associated with the rotating component. The counterweight balance rings 270 have a substantially constant inner diameter.

In one embodiment the plurality of spline teeth 380 are spaced around the circumference of the circular inner surface. In one form the spline teeth 380 are circumferentially spaced around a substantial majority of the counterweight balance ring 270. However, in another form the spline teeth 380 are circumferentially spaced around the entire circular inner surface. Spline teeth 380 are preferably formed substantially parallel with the centerline X, however other geometric relationships between the spline teeth 380 and the centerline X are contemplated herein. The spline teeth 380 are configured to engage with the spline teeth 230*a* to couple the counterweight balance rings 270 to the component 220 and limit the circumferential and radial motion between the counterweight balance rings and the component 220 during rotational movement of the component.

Each of the counterweight balance rings 270 have a mass asymmetry that is adapted to be oriented relative to the component 220 to create an unbalanced correction. In a preferred form the two counterweight balance rings 270 are indexed relative to one another to effect a net unbalance correction vector varying from either zero correction (imbalance of two rings are 180° apart) to a maximum correction of placing the two imbalances in phase with each other thereby creating an imbalance correction capability of twice that of one balance ring. In one embodiment each of the counterweight balance rings 270 is moveable/indexiable independently of the other counterweight balance ring 270 and they are not mechanically fastened to one another.

With reference to FIG. 8, there is illustrated one embodiment of a counterweight balance ring 270. Varying the outer diameter of the ring has created the mass asymmetry of the counterweight balance ring 270. The maximum outer diameter of counterweight balance ring 270 is defined to outer surface 260 and extends over about 180° of the circumference. A minimum outer diameter of the counterweight balance ring 270 is defined to surface 240 and extends over the remaining portion the circumference. In one form of the invention a transition 250 blends together the portions associated with the maximum outer diameter and the minimum outer diameter. The present application contemplates other techniques of creating a mass asymmetry for the counterweight balance ring, including, but not limited to a ring assembly including materials of dissimilar densities and/or an arc of removed spline teeth. In one form of the present invention a orientation mark 290 is present on counterweight balance ring 270. This embodiment contemplates the material set forth above regarding orientation marks for counterweight balance ring 40.

With reference to FIG. 9, there is illustrated one embodiment of the counterweight balance rings 270 located around the component 220. Each of the counterweight balance ring 270 have been oriented to a desired position and the plurality of spline teeth 380 and 230*a* are mated. A retainer 300 is used to fix the counterweight balance rings 270 in place axially after installation. The retainer 300 can be a snap ring, spanner nut, pins, retaining plate and a shaft and face. The position of the counterweight balance rings 270 relative to one another in FIG. 8 is purely illustrative. There is no intention herein to limit the present application to the relative orientation of the counterweight balance rings 270 as set forth in the drawing.

With reference to FIG. 10, there is illustrated in cross section another embodiment of a counterweight balance ring 310. The counterweight balance ring 310 is an undercut ring having a minimum outer diameter defined to surface 370. In one form the minimum outer diameter of ring 310 extends over a minority of the circumference of undercut ring 310. A maximum outer diameter of undercut ring 310 is defined to surface 350 and extends over the remaining majority of the circumference of ring 310. A transition 360 and transition 380 blends the maximum and minimum outer diameter. The present application contemplates that the axial width may be varied as needed to fit the particular application. Further, the radial thickness is contemplated as being variable and a combination of the axial width and radial thickness can be adjusted to obtain the desired imbalance within the physical design envelope.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary.

What is claimed:

1. A system comprising:

a rotatable gas turbine engine component adapted to rotate about a centerline, said component including a first circular portion having a first splined surface with a plurality of first spline teeth;

a pair of counterweight rings located adjacent one another and rotatable with said component, each of said rings having a mass asymmetric portion that is positioned relative to said component to effect an unbalance condition of said component and a second circular portion including a second splined surface with a plurality of second spline teeth for coupling with said plurality of first spline teeth; and wherein said component has a opening parallel with said centerline, said plurality of first spline teeth are located on an outer wall defining said opening, said second splined surface is defined on an outer surface of each of the pair of counterweight rings and said pair of counterweight rings are located within said opening.

2. The system of claim 1, wherein each of said pair of counterweight rings is hoop continuous and carries their own centrifugal load at the operating speeds of the rotatable gas turbine engine component.

3. The system of claim 1, wherein each of said pair of counterweight rings is a full substantially circular ring.

4. The system of claim 1, wherein each of said pair of counterweight rings has a known and equal level of imbalance.

5. The system of claim 4, wherein said pair of counterweight rings are substantially identical.

6. The system of claim 1, wherein said counterweight rings are not positioned concentrically and are not mechanically fastened together.

7. The system of claim 1, wherein said mass asymmetric portion is defined by an arc of up to 180° in circumferential extent.

8. The system of claim 1, wherein each of said pair of counterweight rings requires no in situ change in mass during the balancing of the system.

9. The system of claim 1 wherein each of said pair of counterweight rings is a continuous structure and configured to carry their own centrifugal load at the operating speeds of the rotatable gas turbine engine component; and wherein said pair of counterweight rings are not arranged concentrically and are not mechanically fastened to one another.

10. The system of claim 1, wherein at least one of said pair of counterweight rings having an indicator for said mass asymmetric portion.

11. The system of claim 2, wherein said counterweight rings are not positioned concentrically and are not mechanically fastened together.

12. The system of claim 11, wherein each of said pair of counterweight rings requires no in situ change in mass during the balancing of the system.

13. The system of claim 12, wherein each of said pair of counterweight rings has a known and equal level of imbalance.

14. The system of claim 13, wherein at least one of said pair of counterweight rings having an indicator for said mass asymmetric portion.

* * * * *